US006325534B1

(12) United States Patent
Hawley et al.

(10) Patent No.: US 6,325,534 B1
(45) Date of Patent: Dec. 4, 2001

(54) MEDICATION REMINDER

(75) Inventors: Tarwa L. Hawley, P.O. Box 911, Terrell, TX (US) 75160; Jon H. Kirk, Jr., Hurst, TX (US)

(73) Assignee: Tarwa L. Hawley, Van, TX (US)

( * ) Notice: Subject to any disclaimer, the term of this patent is extended or adjusted under 35 U.S.C. 154(b) by 0 days.

(21) Appl. No.: 09/373,113

(22) Filed: Aug. 12, 1999

(51) Int. Cl.[7] ..... G04B 47/00
(52) U.S. Cl. ..... 368/97; 368/107; 368/10
(58) Field of Search ..... 368/10, 107–113

(56) References Cited

U.S. PATENT DOCUMENTS

| | | |
|---|---|---|
| D. 362,644 | 9/1995 | Chen . |
| D. 380,403 | 7/1997 | Svarnias et al. . |
| 4,283,782 | 8/1981 | Tamaru et al. . |
| 4,432,652 | 2/1984 | Munekata et al. . |
| 4,483,626 | 11/1984 | Noble . |
| 4,905,213 | 2/1990 | Masse et al. . |
| 5,400,301 | 3/1995 | Rackley . |
| 5,715,214 | 2/1998 | Svarnias . |

*Primary Examiner*—Bernard Roskoski

(74) *Attorney, Agent, or Firm*—Jackson Walker L.L.P.

(57) ABSTRACT

An audible alarm device is mounted in a body, and a pair of contact leads are connected to the alarm device, and a contact plate is connected to one of the leads. A dial, mounted on the body of the device, is rotated by a timing device. A plurality of time selector pins are mounted on the dial, and can be selectively positioned inward or outward. When a particular selector pin is in the inward position, the pin will push the contact plate into contact with the second contact lead and activate the alarm device. The alarm can be manually reset by pressing a deactivating piston. As the piston is pressed down, it will push a rod downward with it. The rod will pull downward on a rocker arm, causing the rocker arm to pivot. A second rod is connected to the rocker arm, and will move upward when the rocker arm pivots. The second rod is connected to the contact plate, and will pull the contact plate upward over the selector pin. When the plate is pulled above the pin, the plate will fall back into a vertical position, thus breaking the contact with the second contact lead. When the piston is released, a spring returns it to its upward position, ready for the next selector pin to activate the alarm. If the piston is not manually pressed, the dial will continue to rotate, and the selector pin will eventually pass the contact plate. When the pin passes, the plate will automatically fall back into place, thus resetting itself for the next selector pin.

7 Claims, 7 Drawing Sheets

MEDICATION REMINDER

BACKGROUND OF THE INVENTION

1. Field of the Invention

This invention relates in general to timers and alarms. In particular, the invention relates to alarms for warning people when is time to take medicine.

2. Description of Related Art

Many people take prescription drugs that must be taken on a prescribed schedule. It is sometimes difficult to remember that schedule, especially if the person is taking several different medicines that are on different schedules. Therefore, several devices have been designed to remind people when it is time to take their medicine.

Of course, the ordinary alarm clock can be used for this purpose. That involves setting the alarm clock to go off when it is time for the next dose. However, when the alarm is shut off, the clock must then be reset to go off when it is time for the next dose.

Some medication devices have been designed using digital technology. However, such devices are sometimes difficult to use, especially for older people. Unfortunately, older people are the people who most often need medication devices. Therefore, there was still a need for a simple, easy to use medication reminder.

SUMMARY OF THE INVENTION

The general object of the invention is to remind a person when it is time to take a dose of medicine. In general, this object is accomplished by a medication reminder having an audible alarm device mounted in a body. A pair of contact leads are connected to the alarm device, and a contact plate is connected to one of the leads.

A dial, mounted on the body of the device, is rotated by a timing device. A plurality of time selector pins are mounted on the dial, and can be selectively positioned inward or outward. When a particular selector pin is in the inward position, the pin will push the contact plate into contact with the second contact lead and activate the alarm device. If the particular pin is in the outward position, the pin will bypass the plate and not activate the alarm.

The alarm can be manually reset by pressing a deactivating piston. As the piston is pressed down, it will push a rod downward with it. The rod will pull downward on a rocker arm, causing the rocker arm to pivot. A second rod is connected to the rocker arm, and will move upward when the rocker arm pivots. The second rod is connected to the contact plate, and will pull the contact plate upward over the selector pin. When the plate is pulled above the pin, the plate will fall back into a vertical position, thus breaking the contact with the second contact lead. When the piston is released, a spring returns it to its upward position, ready for the next selector pin to activate the alarm.

If the piston is not manually pressed, the dial will continue to rotate, and the selector pin will eventually pass the contact plate. When the pin passes, the plate will automatically fall back into place, thus resetting itself for the next selector pin.

The above, as well as additional objects, features, and advantages of the invention will become apparent in the following detailed description.

DESCRIPTION OF THE PREFERRED EMBODIMENT

Figure 1:
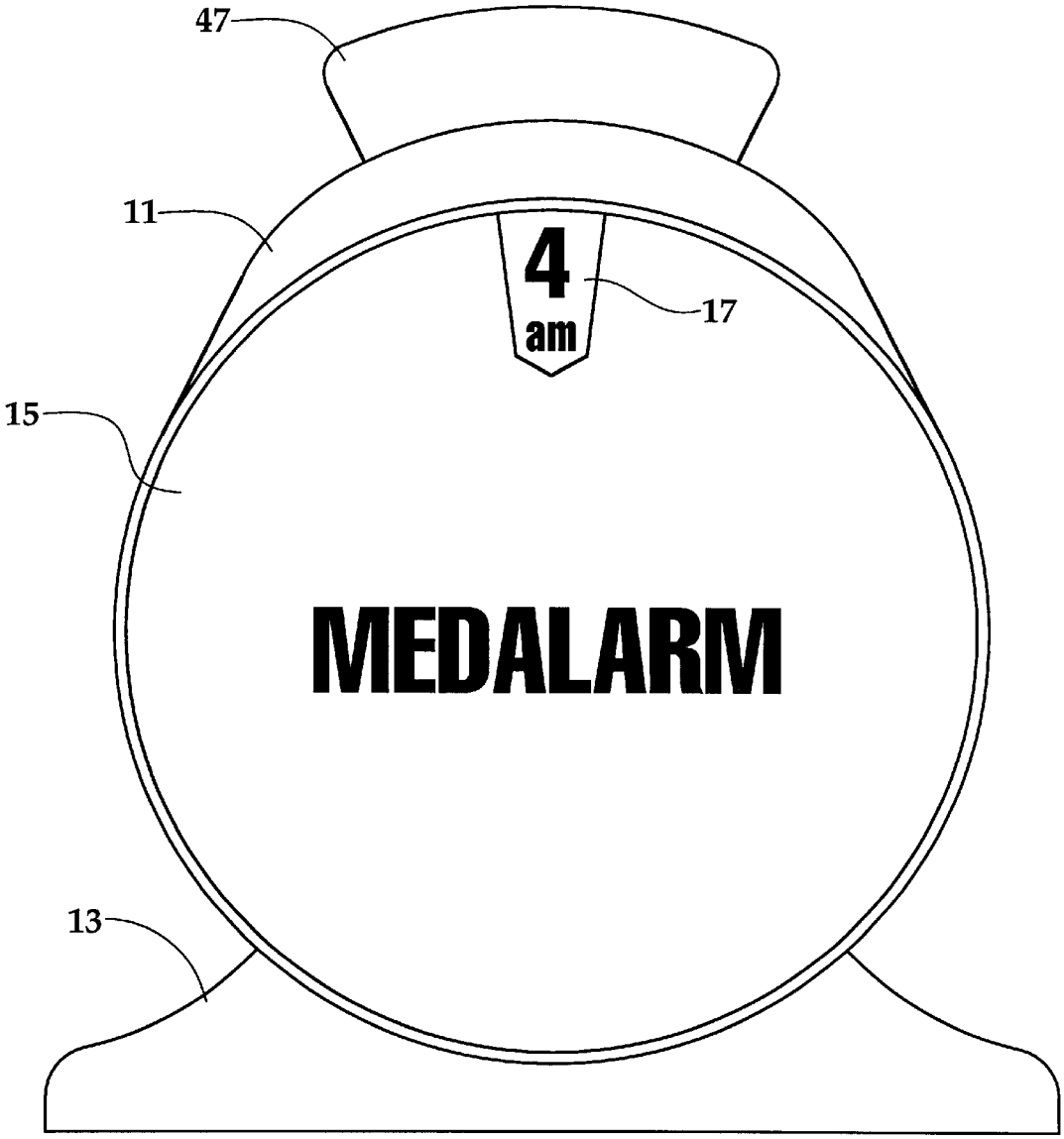
FIG. 1 is a front elevation of a medication reminder according to the preferred embodiment of the invention.

As shown in FIG. 1 of the drawings, the medication reminder of the invention has an outer body 11, mounted on a base 13. The outer body 11 is generally cylindrical, much like a large alarm clock. The base 13 has a flat bottom surface and holds the outer body 11 in a position to make the device easily read and operated.

An opaque, circular cover 15 is mounted on the front of the outer body 11. The cover 15 has a small opening 17 at the top. The cover 15 can easily be removed from the outer body 11 to allow the device to be set. In the preferred embodiment, the cover 15 is removed by turning the cover ninety degrees clockwise. When the cover 15 is replaced, it is placed on the outer body 11 and turned counterclockwise, until the opening 17 is at the top of the cover 15. There are several ways that the cover 15 could be attached to the outer body 11, or the device could be used without a cover 15 at all.

Figure 2:
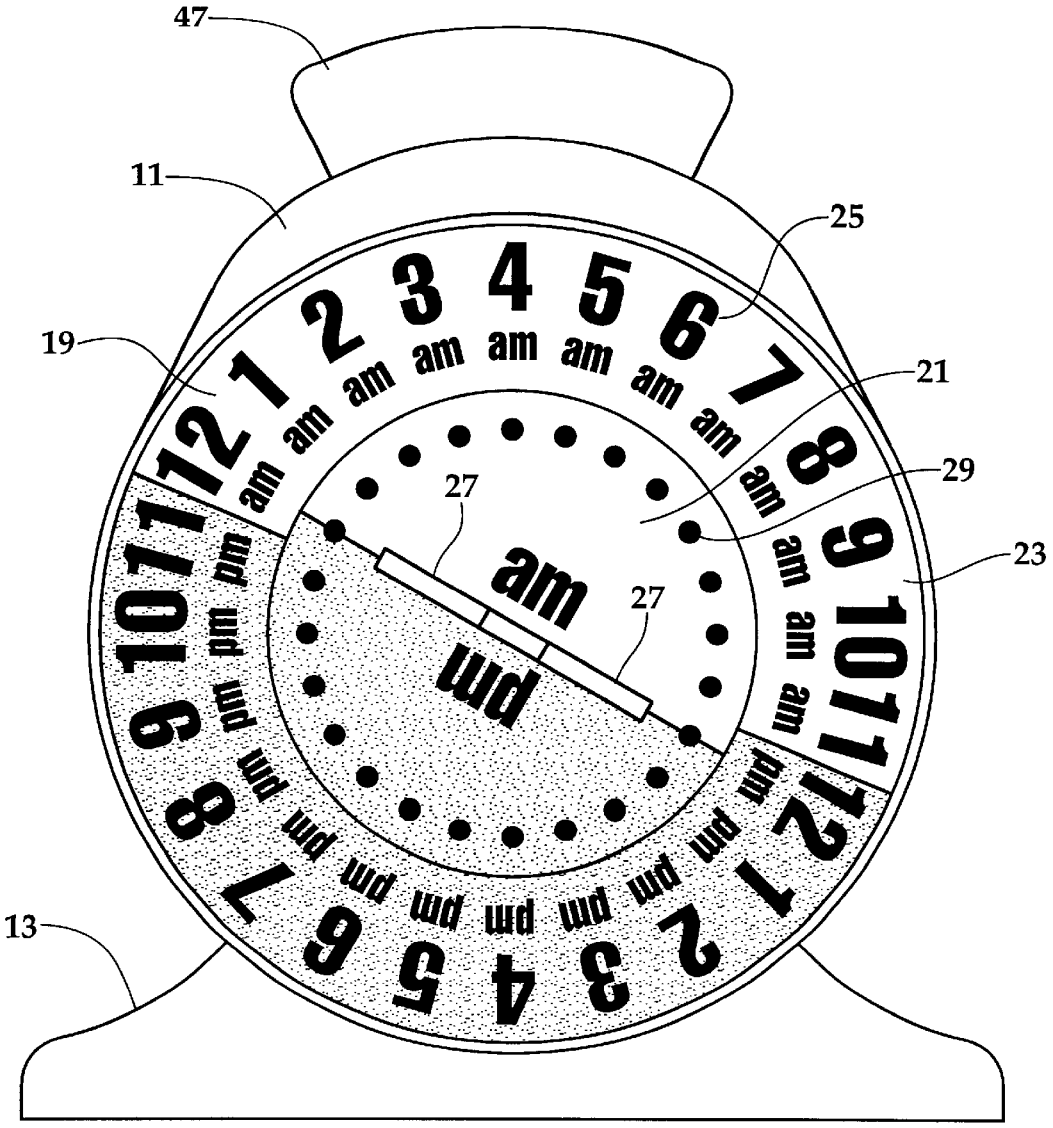
FIG. 2 is a front elevation of a medication reminder, as seen in FIG. 1, with the cover removed.

In FIG. 2, the device is shown without the cover 15. Mounted within the outer body 11 is a circular dial 19. The inner area 21 of the circular dial 19 is recessed from the perimeter area 23 of the dial 19, as can be best seen in FIG. 4.

The dial 19 has twenty-four time indicators 25 spaced evenly around the perimeter area 23 of the dial 19. These time indicators 25 preferably indicate the twenty-four hours in a day. The p.m. hours of the day may be marked on a shaded half of the dial 19, so that it is easy to differentiate between a.m. and p.m. The time indicator 25 that is at the top of the dial 19 can be seen through the opening 17 in the cover 15, when the cover 15 is in place, as shown in FIG. 1.

A pair of tabs 27 are mounted on the recessed inner area 21 of the dial 19, so that the dial 19 can be manually rotated about its center point. The tabs 27 are small flanges that lie on a diameter of the dial 19, as shown in FIG. 2.

A set of twenty four time selector pins 29 are also mounted on recessed inner area 21 of the dial 19. Each time selector pin 29 is mounted radially inward from one of the time indicators 25. The time selector pins 29 can be pushed in or pulled out, to select the times for the medication reminder to be activated.

Figure 3:
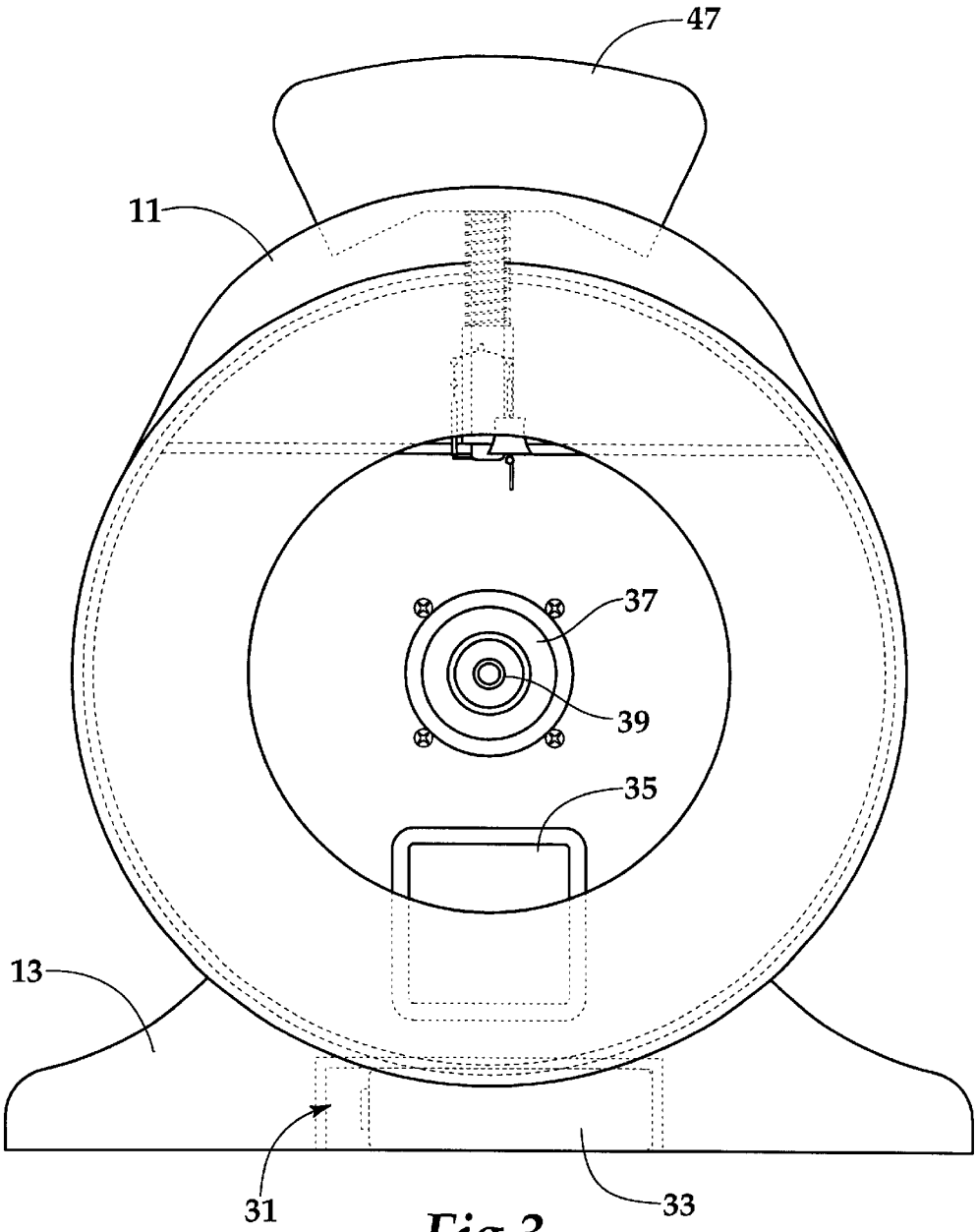
FIG. 3 is a front elevation of a medication reminder, as seen in FIG. 1, with the cover and the dial removed.

FIG. 3 shows the medication reminder of the invention, with the cover 15 and the dial 19 removed. A battery compartment 31 within the base 13 houses a battery 33 for providing electrical power to the medication reminder. An audible alarm device 35 and a timing device 37 are mounted within the body 11 of the device, and are powered by the battery 33. The timing device 37 powers a rotating pin 39, so that the pin 39 rotates counterclockwise, one rotation every twenty four hours. The dial 19 is connected to the rotating pin 39, so the dial is rotated counterclockwise, one rotation every twenty four hours.

Figure 4:
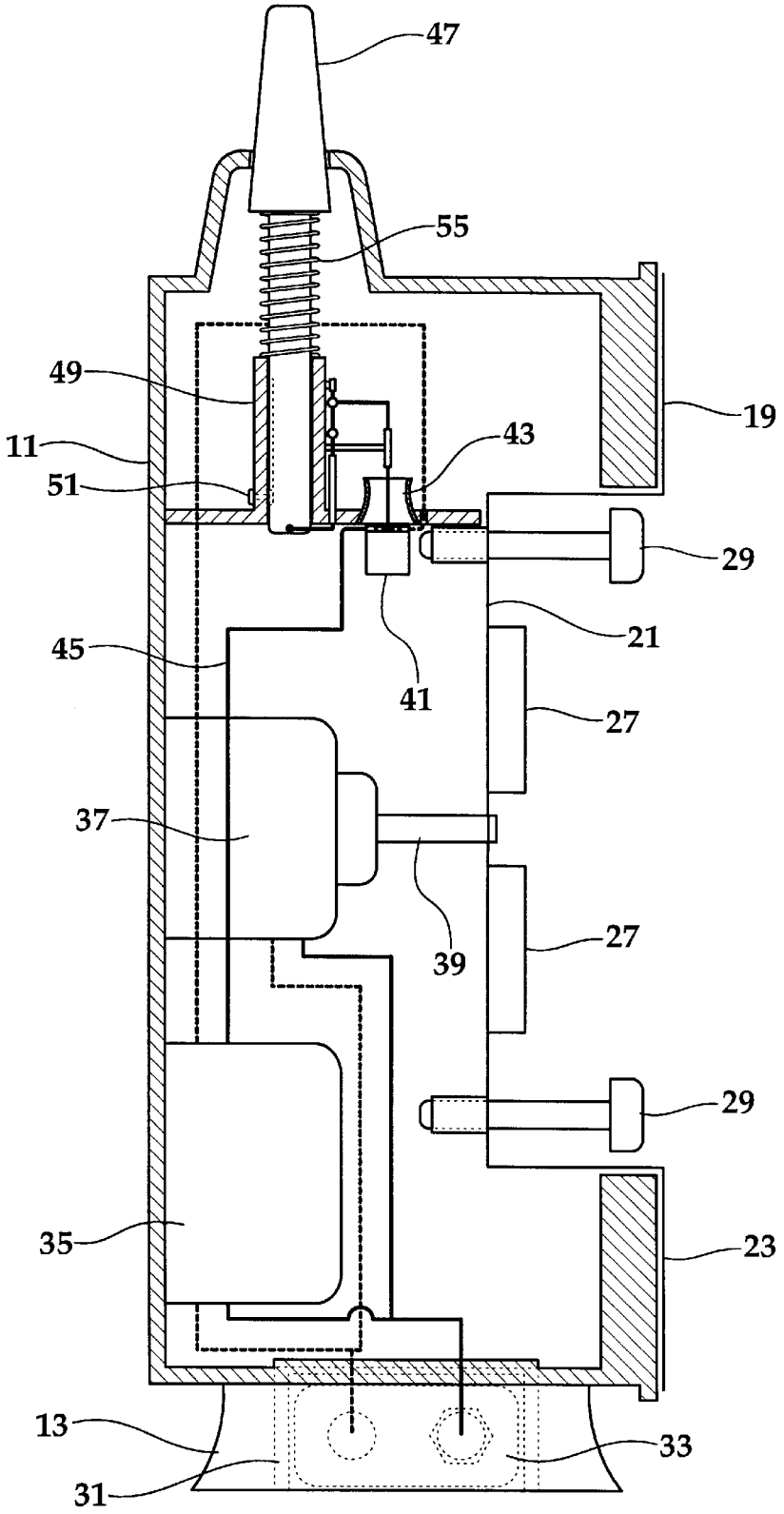
FIG. 4 is a cross-sectional view of the medication reminder, as seen along lines 4—4 in FIG. 1.

As can be seen in FIG. 4, the time selector pins 29 can be selectively placed in either of two positions: an inward position and an outward position. In the outward position, shown in FIG. 4, the time selector pin 29 will bypass a copper contact plate 41 in the body 11 of the device. If a time selector pin 29 is pushed in, to the inward position, then the time selector pin 29 will contact the contact plate 41 and push the contact plate 41 upward when the time selector pin 29 approaches the top of its rotation.

The copper contact plate 41 is attached to a copper contact lead 43 that is electrically connected to the alarm device 35 and thus to the battery 33. A second copper contact lead 45 is mounted near the contact plate 41, so that when a time selector pin 29 pushes the plate 41 upward, the plate 41 contacts the contact lead 45, completing the circuit and setting off the audible alarm device 35.

Figure 5:
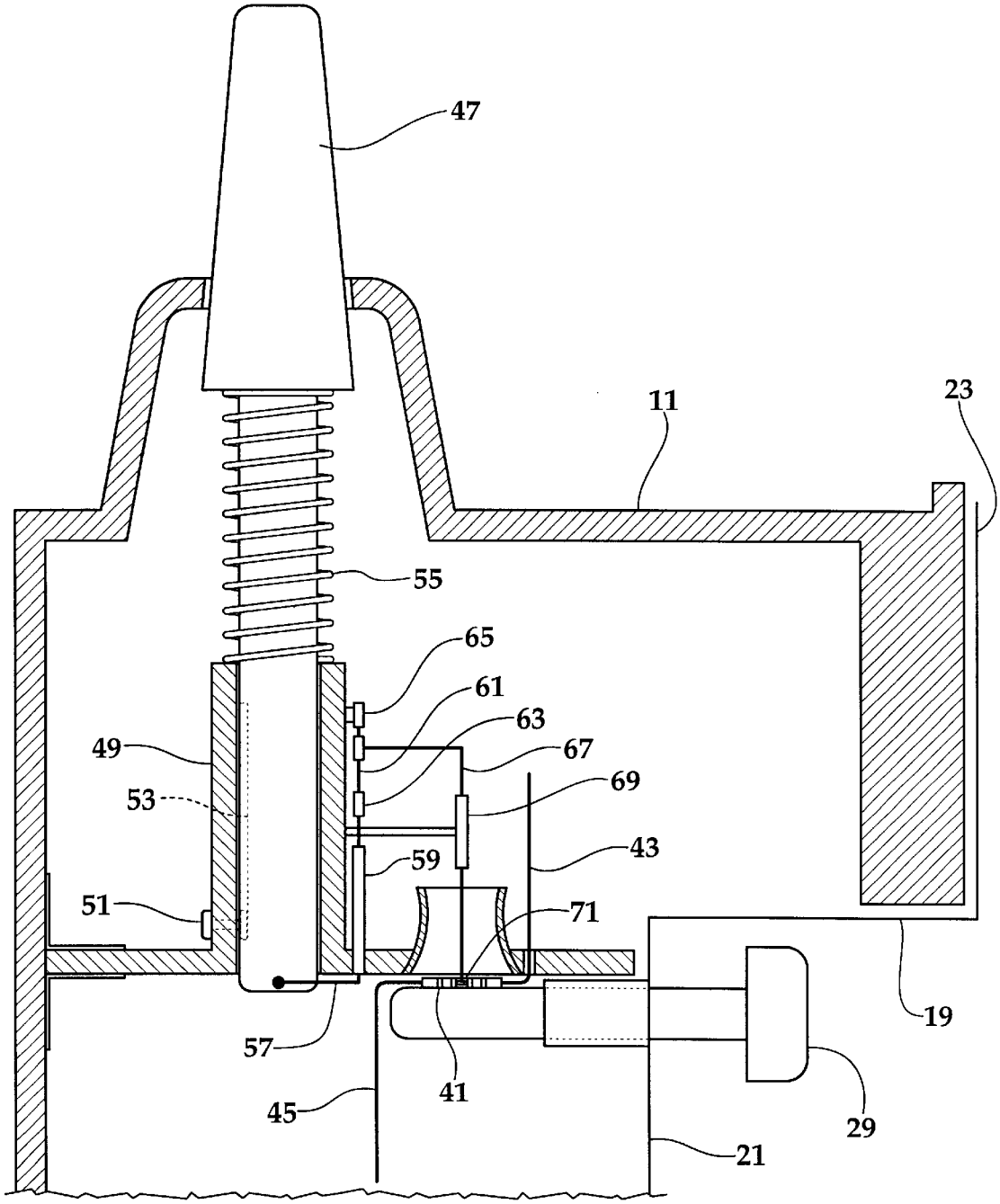
FIG. 5 is an enlarged cross-sectional view of the upper portion of the medication reminder, as seen in FIG. 4.

FIG. 5 shows an enlarged view of the medication reminder. In this view, the time selector pin 29 is in the inward position, so that it pushes up on the contact plate 41 as it passes. The contact plate 41 thus completes the circuit between the first contact lead 43 and the second contact lead 45, thus activating the audible alarm device 35, not shown in this view.

Also shown in FIG. 5 is a deactivating piston 47. The piston 47 is mounted in a piston supporting bushing 49 and extends upward above the body 11 of the device. A double headed pin 51 extends through the piston supporting bushing 49 and into a slot 53 in the back of the piston 47. The pin 51 guides the piston 53 as the piston 47 is depressed, and stops the piston 47 when the piston 47 has reached its lowest point.

A spring 55, mounted between the piston supporting bushing 49 and the top of the piston 47, provides resistance when the piston is depressed. When the piston 47 is released, the spring 55 returns the piston 47 to its upward position.

A rod 57 is attached to the lower end of the piston 47. As shown in FIGS. 5–9, the rod 57 extends forward, and then upward through a rod guide tube 59. A small rod 61 is attached to the rod 57 with a swivel 63. The other end of the small rod 61 is attached to a rocker arm 65. The rocker arm 65 is mounted on the piston supporting bushing 49 in such a manner as to allow the rocker arm 65 to pivot.

A second rod 67 is attached to the other end of the rocker arm 65, and extends downward through a second rod guide tube 69. The second rod guide tube 69 is mounted on the piston supporting bushing 49 and guides the second rod 67. The lower end of the second rod 67 is attached to a hinge 71 on the copper contact plate 41.

Figure 7:
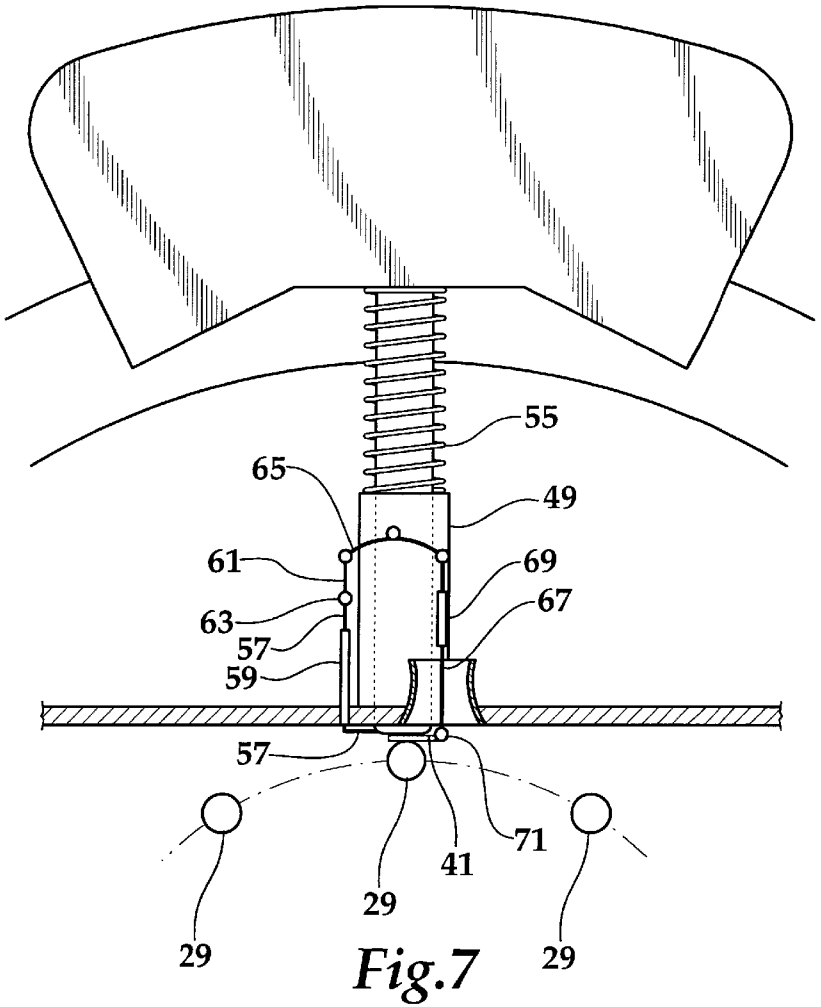
FIG. 7 is an enlarged cross-sectional view of the medication reminder, as seen along lines 6—6 in FIG. 4, as the time selector pin activated the alarm.
Figure 6:
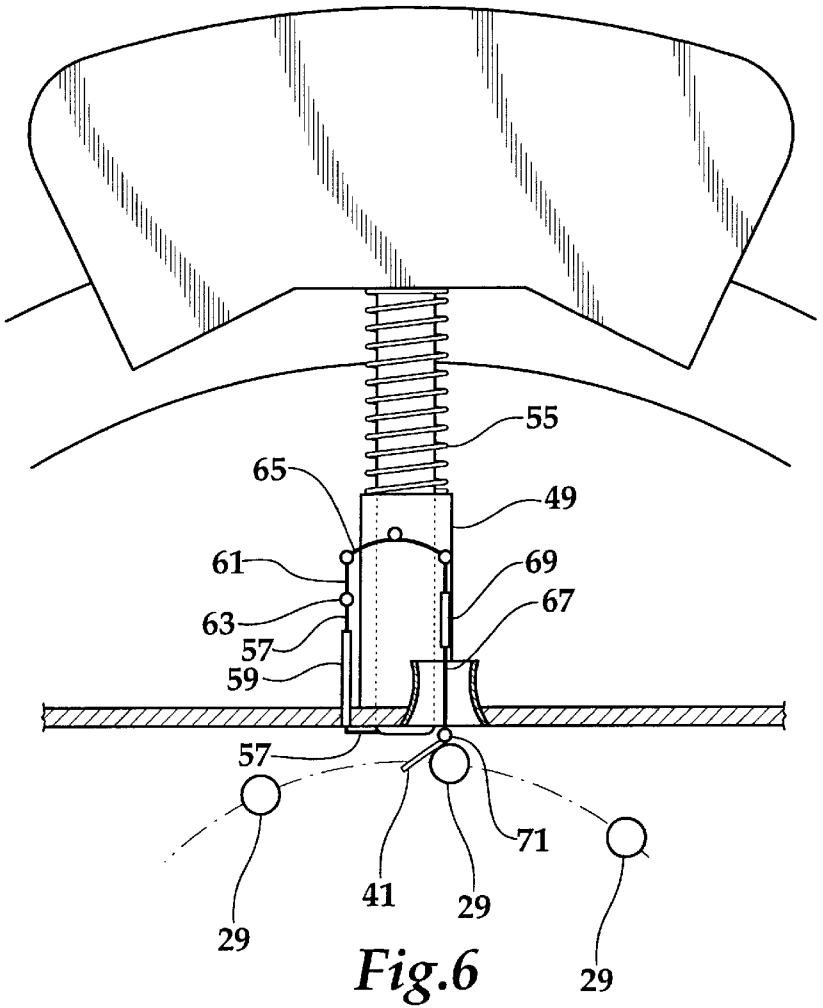
FIG. 6 is an enlarged cross-sectional view of the medication reminder, as seen along lines 6—6 in FIG. 4.

The operation of the device is illustrated best by FIGS. 6–9. In FIG. 6, one of the time selector pins 29 has just contacted the copper contact plate 41. As the selector pins 29 rotate counterclockwise, the pin 29 pushes the plate 41 upward into contact with the contact lead 45, as shown in FIG. 7. This completes the electrical circuit, and sounds the alarm device 35.

Figure 8:
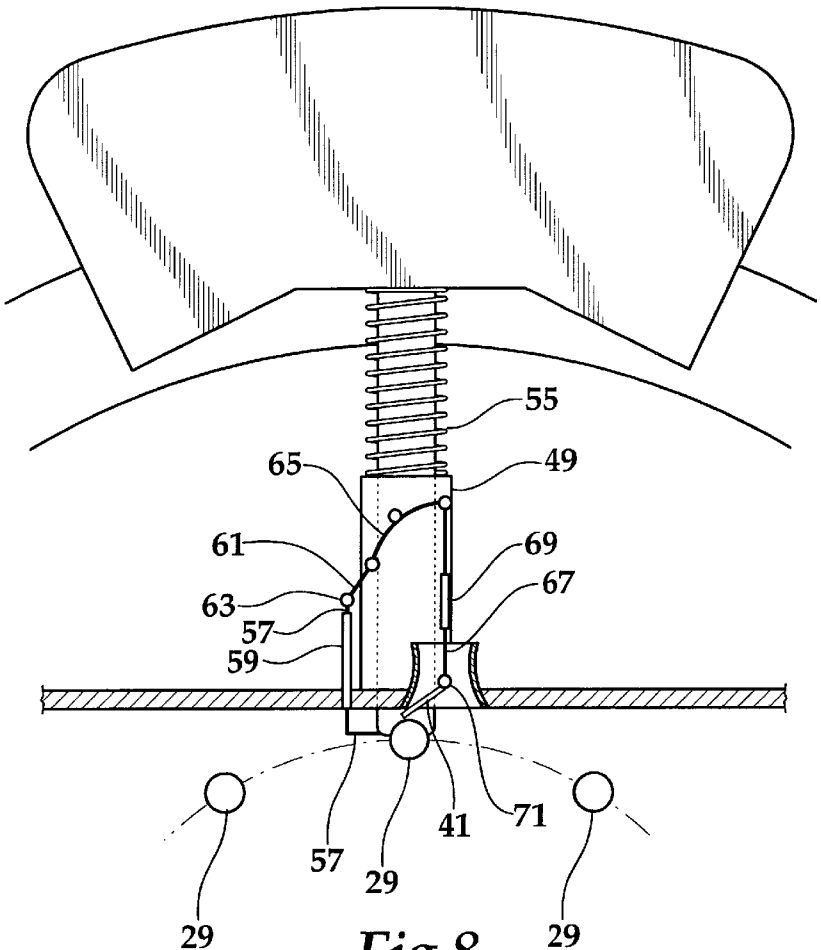
FIG. 8 is an enlarged cross-sectional view of the medication reminder, as seen along lines 6—6 in FIG. 4, as the device is being reset.

At this point, the alarm 35 can be shut off by pressing down on the deactivating piston 47. As shown in FIG. 8, as the piston 47 is pressed down, the piston 47 forces the first rod 57 downward. The rod 57 pulls the small rod 61 downward with it, causing the rocker arm 65 to pivot. As the rocker arm 65 pivots, it pulls the second rod 67 upward. The second rod 67 pulls the hinge 71 upward with it, also raising the contact plate 41 above the time selector pin 29. When the contact plate 41 clears the time selector pin 29, the plate 41 falls back into a vertical position. When the deactivating piston 47 is released, the spring 55 pushes the piston 47 upward, returning the parts to the positions shown in FIG. 9. The device is then ready for the next time selector pin 29 to activate the alarm 35.

Figure 9:
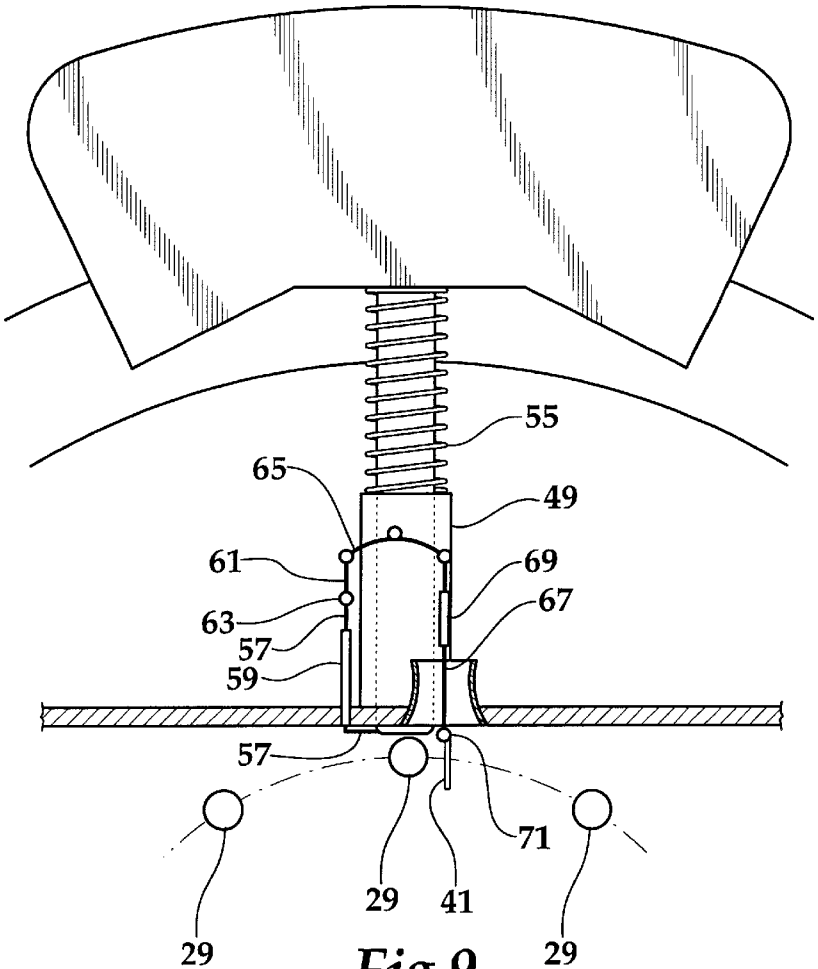
FIG. 9 is an enlarged cross-sectional view of the medication reminder, as seen along lines 6—6 in FIG. 4, in its normal operating position.

If the deactivating piston 47 is not used to deactivate the alarm 35, the dial 19 will continue to rotate, and the time selector pin 29 will pass the contact plate 41. When the time selector pin 29 clears the plate 41, the plate will then drop to a vertical position, as seen in FIG. 9, and the circuit will be broken, thus deactivating the alarm 35 automatically.

The deactivating piston 47, the first rod 57, the rocker arm 65, and the second rod 67 thus combine to form a means for manually deactivating the alarm 35 and resetting the device for the next alarm time. This means could also comprise other elements, such as a flexible line passing over a pulley, rather than the rods and rocker arm.

The medication reminder of the invention has several advantages over the prior art. Device can be set for up to twenty four alarms during a twenty four hour day. The device does not have to be reset after each alarm. The alarm can be reset manually, using the deactivating piston, or, after a short period of time, the device will automatically reset itself.

The invention has been described in only one embodiment. It should be apparent to those skilled in the art that the invention is not so limited, but is susceptible to various changes and modifications without departing from the spirit of the invention.

What is claimed is:

1. A medication reminder, comprising:

a body;

an alarm device, mounted in the body, for sounding an audible alarm;

an electrical power source, connected to the alarm device;

a first contact lead, connected to the alarm device;

a second contact lead, connected to the alarm device;

a contact plate, connected to the first contact lead, and being pivotable between an open position, where the plate contacts the second contact lead to complete an electrical circuit to activate the alarm device;

a dial, mounted on the body;

a timing device, mounted in the body, for rotating the dial;

a plurality of time selector pins, mounted on the dial for rotation with the dial, wherein each pin may be selectively moved between an inward position and an outward position, wherein the pins in the outward position pass by the contact plate and the pins in the inward position push the contact plate into contact with the second contact lead to activate the alarm device; and a deactivating means for manually deactivating the alarm device, wherein the deactivating means automatically resets following an alarm deactivation.

2. A medication reminder, comprising:

a body;

an alarm device, mounted in the body, for sounding an audible alarm;

an electrical power source, connected to the alarm device;

a first contact lead, connected to the alarm device;

a second contact lead, connected to the alarm device;

a contact plate, connected to the first contact lead, and being pivotable between an open position, where the plate contacts the second contact lead to complete an electrical circuit to activate the alarm device;

a dial, mounted on the body:

a timing device, mounted in the body, for rotating the dial;

a plurality of time selector pins, mounted on the dial for rotation with the dial, wherein each pin may be selectively moved between an inward position and an outward position, wherein the pins in the outward position pass by the contact plate and the pins in the inward position push the contact plate into contact with the second contact lead to activate the alarm device; and a deactivating means for manually deactivating the alarm device, where in the deactivating means comprises:

a deactivating piston, mounted on the body and movable between an upper position and a lower position, a first rod, connected to the piston for movement downward with the piston when piston is manually depressed, and a second rod, connected to the rocker arm for movement upward when the rocker arm is pivoted, wherein the second rod is also connected to the contact plate, for raising the contact plate away from the time selector pin, causing the contact plate to fall away from the second contact lead, breaking the electrical circuit and deactivating the alarm device.

3. A medication reminder, comprising:

a body;

an alarm device, mounted in the body for sounding an audible alarm;

an electrical power source, connected to the alarm device;

a first contact lead, connected to the alarm device;

a second contact lead, connected to the alarm device;

a contact plate, connected to the first contact lead, and being pivotable between an open position, where the plate contacts the second contact lead to complete an electrical circuit to activate the alarm device;

a dial, mounted on the body;

a timing device, mounted in the body for rotating the dial;

a plurality of time selector pins, mounted on the dial for rotation with the dial, wherein each pin may be selectively moved between an inward position and an outward position, wherein the pins in the outward position pass by the contact plate and the pins in the inward position push the contact plate into contact with the second contact lead to activate the alarm device;

a deactivating means for manually deactivating the alarm device, wherein the deactivating means comprises:

a deactivating piston, mounted on the body and movable between an upper position and a lower position, a first rod, connected to the piston for movement downward with the piston when piston is manually depressed, and a second rod, connected to the rocker arm for movement upward when the rocker arm is pivoted, wherein the second rod is also connected to the contact plate, for raising the contact plate away from the time selector pin, causing the contact plate to fall away from the second contact lead, breaking the electrical circuit and deactivating the alarm device; and a hinge connecting the second rod to the contact plate to allow the contact plate to move between a first position, where the contact plate is in contact with the second contact lead, and a second position, where the contact plate is separated from the second contact lead.

4. A medication reminder, comprising:

a body;

an alarm device, mounted in the body, for sounding an audible alarm;

an electrical power source, connected to the alarm device;

first contact lead, connected to the alarm device;

a second contact lead, connected to the alarm device;

a contact plate, connected to the first contact lead, and being pivotable between an open position, where the plate contacts the second contact lead to complete an electrical circuit to activate the alarm device;

a dial, mounted on the body;

a timing device, mounted in the body, for rotating the dial;

a plurality of time selector pins, mounted on the dial for rotation with the dial, wherein each pin may be selectively moved between an inward position and an outward position, wherein the pins in the outward position pass by the contact plate and the pins in the inward position push the contact plate into contact with the second contact lead to activate the alarm device;

a deactivating means for manually deactivating the alarm device, wherein the deactivating means comprises:

a deactivating piston, mounted on the body and movable between an upper position and a lower position, a first rod, connected to the piston for movement downward with the piston when piston is manually depressed, and a second rod, connected to the rocker arm for movement upward when the rocker arm is pivoted, wherein the second rod is also connected to the contact plate, for raising the contact plate away from the time selector pin, causing the contact plate to fall away from the second contact lead, breaking the electrical circuit and deactivating the alarm device; and a hinge connecting the second rod to the contact plate to allow the contact plate to move between a first position, where the contact plate is in contact with the second contact lead, and a second position, where the contact plate is separated from the second contact lead, wherein the first position of the contact plate is generally horizontal, and wherein the second position of the contact plate is generally vertical, so that the normal position of the plate will be the vertical position.

5. A medication reminder, comprising:

a body;

an alarm device, mounted in the body, for sounding an audible alarm;

an electrical power source, connected to the alarm device;

a first contact lead, connected to the alarm device;

a second contact lead, connected to the alarm device;

a contact plate, connected to the first contact lead, and being pivotable between an open position, where the plate does not contact the second contact lead, and a closed position, where the plate contacts the second contact lead to complete an electrical circuit to activate the alarm device;

a dial, mounted on the body;

a timing device, mounted in the body, for rotating the dial;

a plurality of time selector pins, mounted on the dial for rotation with the dial, wherein each pin may be selectively moved between an inward position and an outward position, wherein the pins in the outward position pass by the contact plate and the pins in the inward position push the contact plate into contact with the second contact lead to activate the alarm device;

a deactivating piston, mounted on the body and movable between an upper position and a lower position;

a first rod, connected to the piston for movement downward with the piston when the piston is manually depressed;

a rocker arm, connected to the first rod, wherein the rocker arm is pivoted when the first rod moves downward with the piston; and a second rod, connected to the rocker arm for movement upward when the rocker arm is pivoted, wherein the second rod is also connected to the contact plate, for raising the contact plate away from the time selector pin, causing the contact plate to fall away from the second contact lead, breaking the electrical circuit and deactivating the alarm device.

6. A medication reminder as recited in claim 5, further comprising a hinge connecting the second rod to the contact plate to allow the contact plate to move between a first position, where the contact plate is in contact with the second contact lead, and a second position, where the contact plate is separated from the second contact lead.

7. A medication reminder as recited in claim 6, wherein the first position of the contact plate is generally horizontal, and wherein the second position of the contact plate is generally vertical, so that the normal position of the plate will be the vertical position.

* * * * *